United States Patent [19]

Sobieniak

[11] 4,436,609

[45] Mar. 13, 1984

[54] ELECTROLYTIC CELL HAVING AN ELASTOMERIC SHEET COVERING THE CELL BASE

[75] Inventor: Mathew G. Sobieniak, Lewiston, N.Y.

[73] Assignee: J. A. Webb, Inc., Buffalo, N.Y.

[21] Appl. No.: 476,131

[22] Filed: Mar. 17, 1983

[51] Int. Cl.[3] ..... C25B 1/16; C25B 1/26; C25B 9/00

[52] U.S. Cl. ..... 204/267; 204/279

[58] Field of Search ..... 204/279, 252, 253, 267, 204/242

[56] References Cited

U.S. PATENT DOCUMENTS

| | | | |
|---|---|---|---|
| 2,998,374 | 8/1961 | Granfors | 204/279 |
| 3,450,621 | 6/1969 | Anderson | 204/279 |
| 3,794,577 | 2/1974 | Oliver et al. | 204/279 |
| 3,857,775 | 12/1974 | Custer et al. | 204/242 |
| 4,087,343 | 5/1978 | Custer et al. | 204/279 |
| 4,098,670 | 7/1978 | Custer et al. | 204/242 |
| 4,100,053 | 7/1978 | Anderson | 204/279 |

*Primary Examiner*—R. L. Andrews
*Assistant Examiner*—Terryence Chapman

[57] ABSTRACT

The present invention relates to an electrolytic cell having a flexible, heat-resistant elastomeric blanket separating the inside of the cell compartment and the base member. The blanket is fabricated of a thermoplastic elastomeric material. The material is comprised of a blend of thermoplastic polyolefin resin, such as polypropylene or polyethylene, with a polyolefin rubber, preferably a polyolefin rubber such as ethylene-propylene copolymer, i.e., EPM or EPDM. Other rubbers, such as butyl, neoprene or natural rubber may be utilized; however, polyolefin rubbers facilitate particularly useful blends. The polyolefin rubber component may be lightly cross-linked. It is preferred that the polyolefin rubber component be substantially fully cross linked and that the crystalline polyolefin resin be the only component in continuous phase.

6 Claims, 1 Drawing Figure

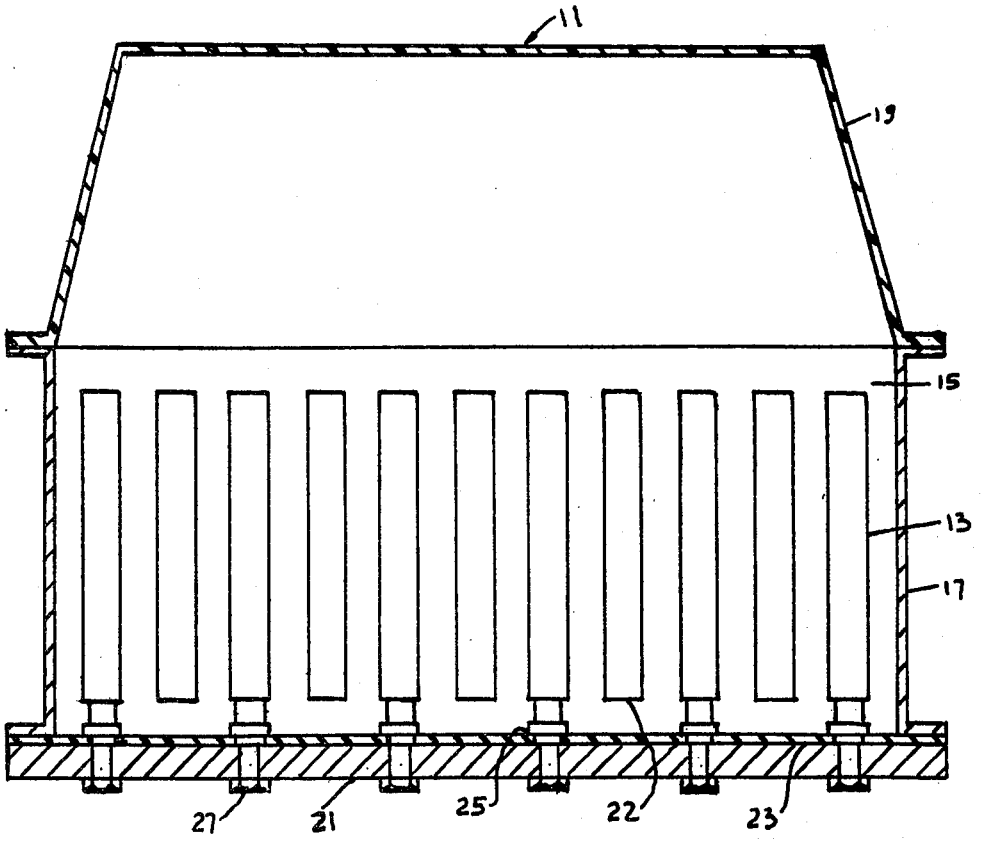
11
19
15
13
17
27
21
25
22
23

ELECTROLYTIC CELL HAVING AN ELASTOMERIC SHEET COVERING THE CELL BASE

BACKGROUND OF THE INVENTION

A number of industrial processes are based upon the electrolysis of aqueous salt solutions. Among the most important of these is the electrolysis of alkali metal chlorides to produce the corresponding alkali metal hydroxide and chlorine, or the corresponding alkali metal chlorate. Of the alkali metal chlorides, sodium chloride is the most abundant and is most utilized.

One widely employed method of electrolysis is the utilization of a cell having separate anode and cathode compartments. The compartments are separated by a porous separator. For some years, such cells utilized a separator of fibrous asbestos. More recently with the advent of metal, or dimensionally stable, anodes, permselective separators, such as fluorocarbon resin modified asbestos mixtures, have substantially replaced asbestos as the separator component. Such cells typically have a conductive base in which the anode members, generally flat blades, are vertically positioned. The base is separated from the interior of the cell compartment by a cover, or blanket, of elastomeric material. Typically, anode members are flanged and are inserted through perforations in the blanket and into electrical contact with the base. The base portions of the anode members are usually threaded to accept a metallic, usually copper, stud which extends through said base and be fixedly attached thereto, e.g., with a nut. In any case, the arrangement allows the base portion to be electrically attached to the anode members and separated from the remainder of the cell compartment.

In use, electrolytic cells are operated on a continuous basis, that is, the process is operated until one of the cell components requires replacement. For example, the separator may be required to be replaced because of clogging or leakage, the anodes because of wear, or the blanket because of leakage. Thus, it is important to utilize cell components which have a long life under cell operating conditions. As one component is improved, development work concentrates on the next most weak component.

Previously elastomeric blankets have been fabricated of neoprene rubber, EPDM compositions or various blends of natural and synthetic rubbers. U.S. Pat. Nos. 3,794,577 and 3,857,775 recite examples. However, none of these materials has proved totally satisfactory in actual use. Although each variation has lengthened the life of the blanket, the improvements in blanket life have not been sufficient to provide a blanket which would have a longer life than the other cell components.

The present invention provides a cell having a cell blanket with an extraordinary life when utilized in the hostile operating conditions of an electrolytic cell. Further, the present cell blanket has a substantially improved shelf life as compared to conventional blankets. Conventional vulcanized blankets tend to shrink over time and, because of the exacting fit required, must be fabricated and installed prior to such shrinkage. The present cell blankets are substantially dimensionally stable and may be fabricated and stored for time periods not previously attained by prior art blankets.

The present blankets also exhibit a substantial improvement in the compression set of the blanket. Compression set is a measure of the ability of the blanket to return to its original dimensions after compression. Such improvement facilitates a tight, sure seal between the base member and the portion of the anode members positioned in the operating portion of the cell.

BRIEF DESCRIPTION OF THE INVENTION

The present invention relates to an electrolytic cell having a flexible, heat-resistant elastomeric blanket separating the inside of the cell compartment and the base member.

The present blanket is fabricated of a thermoplastic elastomeric material. The material is comprised of a blend of thermoplastic polyolefin resin, such as polypropylene or polyethylene, with a polyolefin rubber, preferably a polyolefin rubber such as ethylene-propylene copolymer, i.e., EPM or EPDM. Other rubbers, such as butyl, neoprene or natural rubber may be utilized; however, polyolefin rubbers facilitate particularly useful blends. The polyolefin rubber component may be lightly cross-linked. The crystalline polyolefin resin and rubber may form a two-phase system in which both phases are continuous. Such blends are described in U.S. Pat. No. 4,130,535, which disclosure is incorporated herein by reference. However, it is preferred that the polyolefin rubber component be substantially fully crosslinked and that the crystalline polyolefin resin be the only component in continuous phase.

DETAILED DESCRIPTION OF THE INVENTION

The accompanying figure is a schematic, side elevation of a typical diaphragm-type electrolytic cell equipped with a protective elastomeric blanket in accord with the present invention.

Looking now at the figure in detail, cell 11 comprises a plurality of dimensionally stable anodes, such as 13, positioned within cell compartment 15. Cell compartment 15 has side walls 17 and top 19. Typically, the top member is removable to allow access to the inside of cell compartment 15. Anodes 13 are fabricated of any material that is suitable for the electrolytic process, for example, platinum group metals and their oxides, either alone or as a coating over titanium or tantalum. Generally, the anodes may be any configuration; usually, anodes are in the form of sheets, blades, exapanded or perforated metal.

Cell 11 has a conductive base member 21, preferably of copper, whose purpose is to conduct electrical current from a source, not shown, and distribute current to the anode members 13. Base member 21 is separated from the inside of cell compartment 15 by protective blanket 23. Blanket 23 is equipped with holes, which align with the base portions of anode members 13. Anode members 13 have flanges 25 which rest upon blanket 23. As shown, the bottom portions of anode members 13 extend through base member 21 and are suitably maintained in a vertical position by nuts, such as 27. Tightening nuts 27 provides a liquid-tight seal of blanket 23 at the juncture of flanges 25 and base 21 and facilitates electrical connection of anode members 13 with base 21. Cathode members 22 are positioned between anode members 13 to facilitate the passage of current within the cell. In operation, the compartment is charged with a brine solution and, upon passage of current through the compartment, chlorine is formed at the anode, and hydrogen is formed at the cathode.

Blanket 23 is fabricated of a blend of thermoplastic polyolefin resin and a rubber, preferably a polyolefin, which are formed into a thermoplastic vulcanizate. The blends from which the thermoplastic vulcanizates are prepared comprise about 25–95 percent by weight of resin and about 75–5 percent by weight of rubber. The proportion of the rubber is sufficiently high that the thermoplastic vulcanizates are elastomers.

The thermoplastic elastomers utilized in blanket 23 are fully cured vulcanizates of compositions comprising blends of (a) 25–75 percent by weight of thermoplastic polyolefin resin and (b) about 75–25 percent by weight of rubber. Other ingredients may be present, for example, oil or fillers.

The present cell blanket has a compression set of less than 85 percent. Compression set is determined by compressing a layer of material by 25 percent of its thickness, that is, to 75 percent of its normal thickness, and holding such compression for a period of seventy hours at a temperature of 121° C. After release, the layer should immediately regain at least 15 percent of the 25 percent to which the material was compressed.

Preferably, monoolefin copolymer rubber is utilized in the present blends. Suitably, such rubbers comprise essentially non-crystalline, rubbery copolymer of two or more alpha monoolefins, preferably copolymerized with at least one polyene, usually a diene. However, saturated monoolefin copolymer rubber, commonly called "EPM" rubber, can be used, for example, copolymers of ethylene and propylene. Examples of unsaturated monoolefin copolymer rubber, commonly called "EPDM" rubber, which are satisfactory comprise the products from the polymerization of monomers comprising two monoolefins, generally ethylene and propylene, and a lesser quantity of non-conjugated diene. Suitable alpha monoolefins are illustrated by the formula $CH_2{=}CHR$ in which R is hydrogen or alkyl of 1–12 carbon atoms, examples of which include ethylene, propylene, 1-butene, 1-pentene, 1-hexene, 2-methyl-1-propene, 3-methyl-1-pentene, 4-methyl-1-pentene, 3,3-dimethyl-1-butene, 2,4,4-trimethyl-1-pentene, 5-methyl-1-hexene, 1,4-ethyl-1-hexene and others. Satisfactory non-conjugated dienes include straight chain dienes, such as 1,4-hexadiene, cyclic dienes, such as cyclooctadiene, and bridged cyclic dienes, such as ethyldienenorborene.

Other rubbers may be utilized, for example, butyl or halobutyl rubbers. Butyl rubbers contain a major portion of bound isobutylene, e.g., from about 85 to 99.5 percent by weight and a minor portion of isoprene, e.g., from about 15 to 0.5 percent by weight. Halobutyl rubbers include chlorobutyl as well as bromobutyl rubber. Descriptions of halobutyl rubbers are found in U.S. Pat. No. 3,242,148.

Neoprene rubber may be used. Such polychloroprene rubbers are well known in the art. Natural rubber, particularly pale crepe and smoke sheet, chemically treated natural rubber or balata, are useful. Blends of rubbers may be used.

Suitable thermoplastic polyolefin resins comprise crystalline, high molecular weight solid products from the polymerization of one or more monoolefins by either high pressure or low pressure processes. Examples of such resins are the isotactic and syndiotactic monoolefin polymer resins, representative members of which are commercially available. Examples of satisfactory olefins are ethylene, propylene, 1-butene, 1-pentene, 1-hexene, 2-methyl-1-propene, 3-methyl-1-pentene, 4-methyl-1-pentene, 4-methyl-1-pentene, 5-methyl-1-hexene and mixtures thereof.

Any curative or curative system applicable for vulcanization of monoolefin rubbers may be used in the practice of the invention, for example, peroxide-azide- and accelerated sulfur-vulcanizing agents. The combination of a maleimide and disulfide accelerator may be used. Activators, such as zinc oxide, magnesium oxide and stearic acid, may be utilized to enhance the cure.

The blankets are fabricated by known means. Generally, the rubber and resin are blended. This may be accomplished by conventional mixing techniques, using conventional rubber processing equipment, such as a Banbury mixer or a mixing mill. The blend is melted and formed into a thermoplastic sheet containing vulcanized materials in a conventional manner, e.g., by using a rubber colander or extruder to form a sheet of the desired dimensions and subsequently forming anode receiving holes in the sheet, suitably by drilling.

The foregoing description and embodiments are intended to illustrate the invention without limiting it thereby. It will be understood that various modifications can be made in the invention without departing from the spirit or scope thereof.

What is claimed is:

1. In an electrolytic cell comprising a cell compartment, a conductive metal base within said compartment, a flexible heat-resistant elastomeric base sheet within the bottom portion of said compartment covering and in contact with said metal base, a plurality of anode members mounted within said compartment in electrical contact with said base member, the bottom portion of said anode members passing through said elastomeric sheet and forming a liquid-tight seal separating said base member from said cell compartment, a plurality of cathode members positioned within said compartment to facilitate the passage of electrical current through said compartment, the improvement which comprises the use of a composite, thermoplastic elastomeric base sheet fabricated of a mixture of from about 25 to about 75 percent by weight of thermoplastic polyolefin resin and from about 25 to about 75 percent by weight of rubber selected from the group of polyolefin rubber, butyl rubber, neoprene, natural rubber and mixtures thereof.

2. The electrolytic cell of claim 1 wherein the rubber component of the elastomeric sheet is polyolefin rubber.

3. The electrolytic cell of claim 2 wherein the said rubber component is an ethylene - propylene copolymer.

4. The electrolytic cell of claim 1 wherein the said rubber component is butyl rubber.

5. The electrolytic cell of claim 1 wherein the said rubber component is neoprene.

6. The electrolytic cell of claim 1 wherein the said rubber component is natural rubber.

* * * * *